US007113060B2

(12) United States Patent
Ito et al.

(10) Patent No.: US 7,113,060 B2
(45) Date of Patent: Sep. 26, 2006

(54) DIELECTRIC WAVEGUIDE FILTER WITH INDUCTIVE WINDOWS AND COPLANAR LINE COUPLING

(75) Inventors: Masaharu Ito, Tokyo (JP); Kenichi Maruhashi, Tokyo (JP); Keiichi Ohata, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/332,267

(22) PCT Filed: Jul. 6, 2001

(86) PCT No.: PCT/JP01/05894

§ 371 (c)(1),
(2), (4) Date: Apr. 10, 2003

(87) PCT Pub. No.: WO02/05379

PCT Pub. Date: Jan. 17, 2002

(65) Prior Publication Data

US 2003/0155865 A1 Aug. 21, 2003

(30) Foreign Application Priority Data

Jul. 7, 2000 (JP) ..... 2000-207459

(51) Int. Cl.
*H01P 1/208* (2006.01)

(52) U.S. Cl. ..... 333/212; 333/230

(58) Field of Classification Search ..... 333/208, 333/212, 230

See application file for complete search history.

(56) References Cited

U.S. PATENT DOCUMENTS 5,382,931 A * 1/1995 Piloto et al. ..... 333/208
5,982,256 A * 11/1999 Uchimura et al. ..... 333/239
6,259,337 B1 * 7/2001 Wen ..... 333/246
6,535,083 B1 * 3/2003 Hageman et al. ..... 333/210
6,677,837 B1 * 1/2004 Kojima et al. ..... 333/208

FOREIGN PATENT DOCUMENTS

| | | | |
|---|---|---|---|
| JP | 62-5702 | A | 1/1987 |
| JP | 3-212003 | A | 9/1991 |
| JP | 7-170105 | A | 7/1995 |
| JP | 7-254804 | A | 10/1995 |
| JP | 9-232809 | A | 9/1997 |
| JP | 10-303618 | A | 11/1998 |
| JP | 11-284409 | A | 10/1999 |

* cited by examiner

*Primary Examiner*—Benny Lee
(74) *Attorney, Agent, or Firm*—Sughrue Mion, PLLC

(57) ABSTRACT

A dielectric waveguide tube band-pass filter assuming lower characteristic change upon mounting, and having smaller dimensions and lower loss. Conductor layers (2*a*, 2*c*) are formed on the top and bottom surfaces of a dielectric substrate (1), wherein the top conductor layer 2*a* and the bottom conductor layer 2*c* are connected together through via-holes (3*a*). The via-holes (3*a*) are formed in at least two rows along the signal transfer direction. In the dielectric waveguide tube configured by the top and bottom conductor layers (2*a*, 2*c*) and the via-holes (3*a*), via-holes (3*b*) are arranged in the signal transfer direction at spacing equal to or below ½ of the in-tube wavelength to thereby configure resonators. The dielectric band-pass filter is configured by coupling adjacent resonators together through the via-holes (3*b*) configuring inductive windows. On the surface of the dielectric substrate (1), a co-planar line (4) including the conductor layer (2) as the ground and the conductor layer (2*b*) as a signal conductor is configured so as to overstride the inductive windows configured by the via-holes (3*a*).

14 Claims, 9 Drawing Sheets

DIELECTRIC WAVEGUIDE FILTER WITH INDUCTIVE WINDOWS AND COPLANAR LINE COUPLING

TECHNICAL FIELD

The present invention relates to a filter having a dielectric waveguide tube structure for use as a high-frequency component.

TECHNICAL BACKGROUND

Conventional filters used in a high-frequency range include a filter using a ¼-wavelength or ½-wavelength resonator including micro-strip or coplanar line, which is a planar filter expected to have smaller dimensions.

Waveguide tube filters which can be expected to have a lower loss include a dielectric waveguide tube filter, which is smaller in dimensions compared to a rectangular waveguide tube. In the dielectric waveguide tube filter described in Patent Publication JP-A-11-284409, for example, and shown in FIGS. 11A and 11B. the waveguide tube is configured by forming conductor layers 2*a* and 2*c* (FIG. 11B ) on the top and bottom surfaces of a dielectric substrate 1, the top conductor layer 2*a* and the bottom conductor layer 2*c* are connected together through via-hole arrays 3*a*, which are formed so that a spacing 1*p* (FIG 11 A) along the signal transfer direction is equal to or less than ½ of the in-tube wavelength. In addition, via-holes 3*b* constituting the inductive windows are formed in the waveguide tube thus configured so that the spacings (11, 12, 13 and 14) are equal to or less than ½ of the in-tube wavelength, thereby realizing a filter.

However, in the planar filter, since the electromagnetic wave is concentrated in a narrow area, the loss thereof increases due to the conductor loss or dielectric loss. In addition, since the electromagnetic wave expands outside the dielectric substrate constituting the planar filter, there is a problem in that the filter characteristic is changed due to the influence by a package when it is mounted on the package.

Further, as for the dielectric waveguide tube filter described in JP-A-11-284409, if a filter having a steep out-of-band suppression characteristic is to be achieved therefrom, the filter will have a larger number of stages and thus larger dimensions. Thus, there also arises a problem in that designed characteristics cannot be achieved due to limited manufacturing accuracy.

SUMMARY OF THE INVENTION

In view of the above, it is an object of the present invention to provide a filter assuming smaller characteristic change upon mounting thereof, and having smaller dimensions and lower loss. The present invention provides a dielectric waveguide tube filter having a dielectric waveguide tube structure comprising a top conductor layer and a bottom conductor layer on the surfaces of a dielectric substrate, wherein the side wall of a waveguide tube and inductive windows are configured by conductors connecting the top conductor layer and the bottom conductor layer together, characterized in that: a planar line is configured on the surface of at least one of the top conductor layer and the bottom conductor layer.

In the filter of the present invention, it is preferable that at least two via-hole arrays be formed wherein via-holes connecting together the top conductor layer and the bottom conductor layer disposed on the surfaces of the dielectric substrate are arranged in rows along the signal transfer direction at a spacing equal to or below ½ of the in-tube wavelength in the desired band, and the inductive windows coupling together the resonators formed by the area surrounded by the via-hole arrays, top conductor layer and the bottom conductor layer be configured by the via-holes.

In addition, it is preferable that the planar line formed on the top conductor layer or the bottom conductor layer overstride at least one of the windows, thereby configuring a transmission path.

The planar line as used herein means a line (slot line, co-planar line etc.) including at least one slot configured by removing a part of the top conductor layer or the bottom conductor layer.

It is also preferable that a planar line formed on the dielectric substrate constitute a coplanar line including two combined slots formed along the transfer direction of the signal transferring within the waveguide tube.

It is preferable that the ground conductors on both sides of the signal conductor constituting the coplanar line be connected together via a conductor piece.

It is preferable that the conductors disposed on both sides of the slots constituting the planar line be connected together via a conductor piece for adjusting the filter.

It is preferable that at least one of both sides of the coplanar line be an open end, a first conductor piece be formed apart from the open end of the signal conductor, and the first conductor piece and the signal conductor be connected together via a second conductor piece for adjusting the filter.

It is preferable that the filter include a coplanar line for inputting/outputting a signal, and a coplanar waveguide tube conversion structure.

It is preferable that the conductors constituting the coplanar line be connected together via a conductor piece formed on a flip-chip mounting substrate and bumps.

BEST MODES FOR THE INVENTION

Figure 1A:
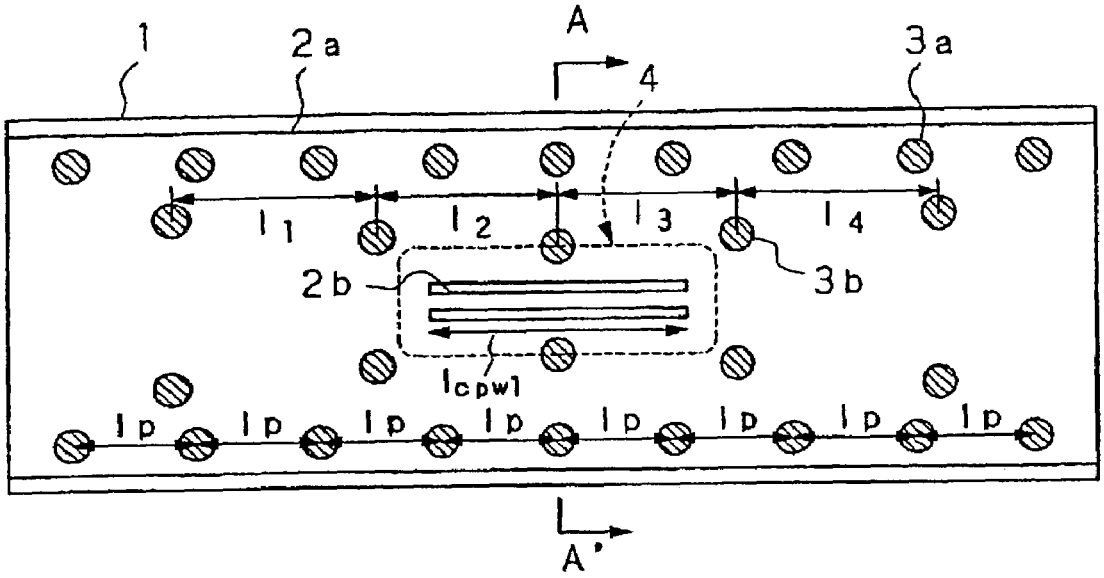
FIG. 1A is a top plan view of a filter according to a first embodiment of the present invention.
Figure 1B:
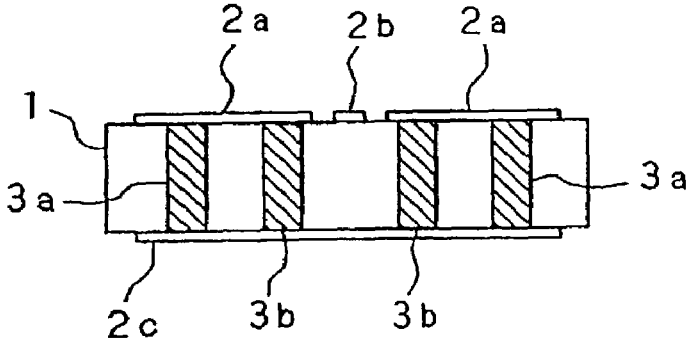
FIG. 1B is a sectional view taken along line A–A' in FIG. 1A.

The drawings will be described below in detail, in which like reference numerals in different drawings refer to the same feature. Accordingly, each feature may not be described in detail for each of the drawings. With reference to FIGS. 1A and 1B, a first embodiment of the present invention will be described in detail. Conductor layers are formed on the top surface and the bottom surface of a dielectric substrate such as made of ceramics, wherein the top conductor layer 2*a* and the bottom conductor layer 2*c* are connected together through via-holes 3*a* penetrating the dielectric substrate 1. The plurality of via-holes 3*a* are formed at least in two rows along the signal transfer direction. In order for the area surrounded by the top conductor layer 2*a*, bottom conductor layer 2*c* (FIG. 1B) and via-holes 3*a* to configure a waveguide tube in a desired band, it is preferable that the spacing 1*p* (FIG. 1A) of the via-holes 3*a* along the signal transfer direction be equal to or below ½ of the in-tube wavelength in the desired band. In addition, in order to sufficiently suppress the loss due to the radiation from between the via-holes 3*a*, it is preferable that the spacing be equal to or below ¼ of the in-tube wavelength. By forming via-holes 3*b* arranged in the dielectric waveguide tube at spacings (11, 12, 13 and 14) in FIG. 1A which are below ½ of the in-tube wavelength along the signal transfer direction, the zone sandwiched between the via-holes 3*b* configures a resonator. In addition, by coupling the adjacent resonators through the via-holes 3*b* constituting inductive windows, a dielectric band-pass filter is configured.

Figure 2:
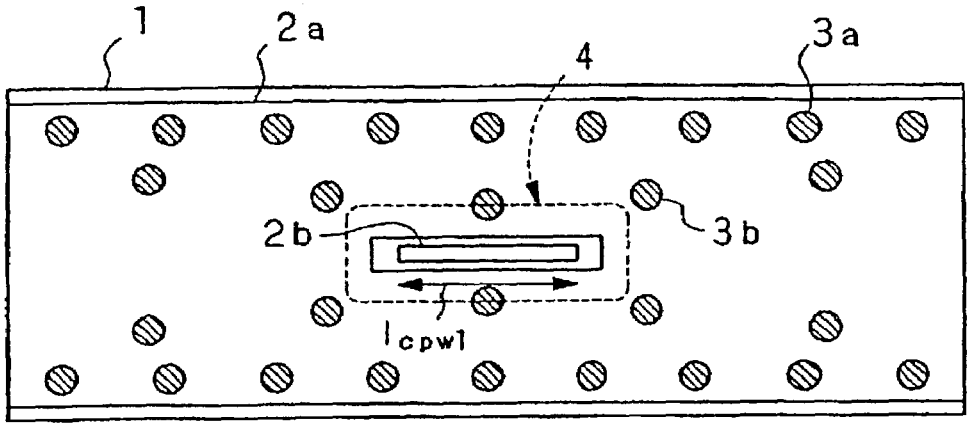
FIG. 2 is a top plan view of a filter according to a second embodiment of the present invention.
Figure 3:
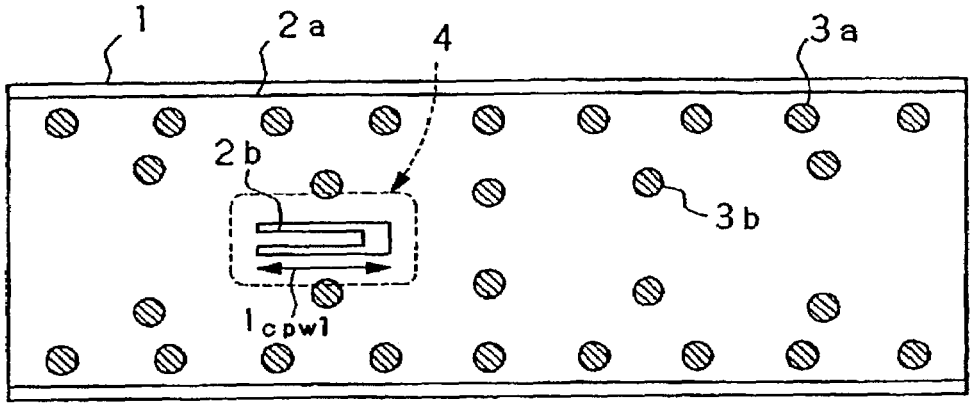
FIG. 3 is a top plan view of a filter according to a third embodiment of the present invention.
Figure 4:
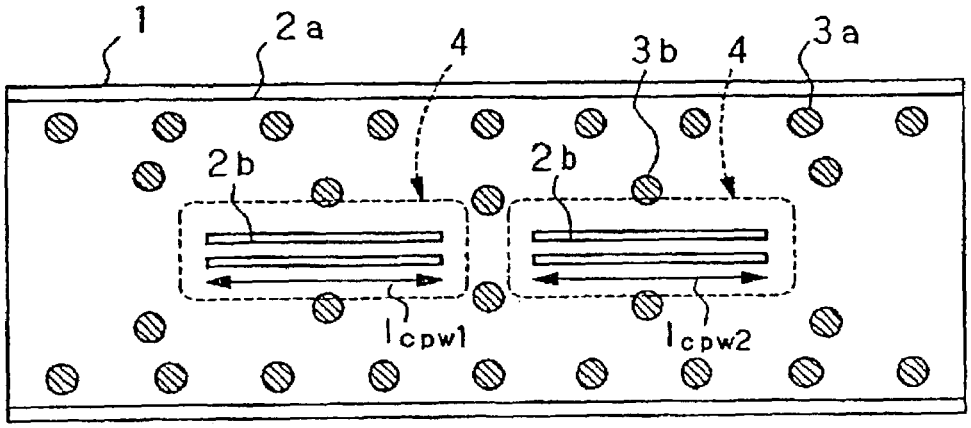
FIG. 4 is a top plan view of a filter according to a fourth embodiment of the present invention.
Figure 12:
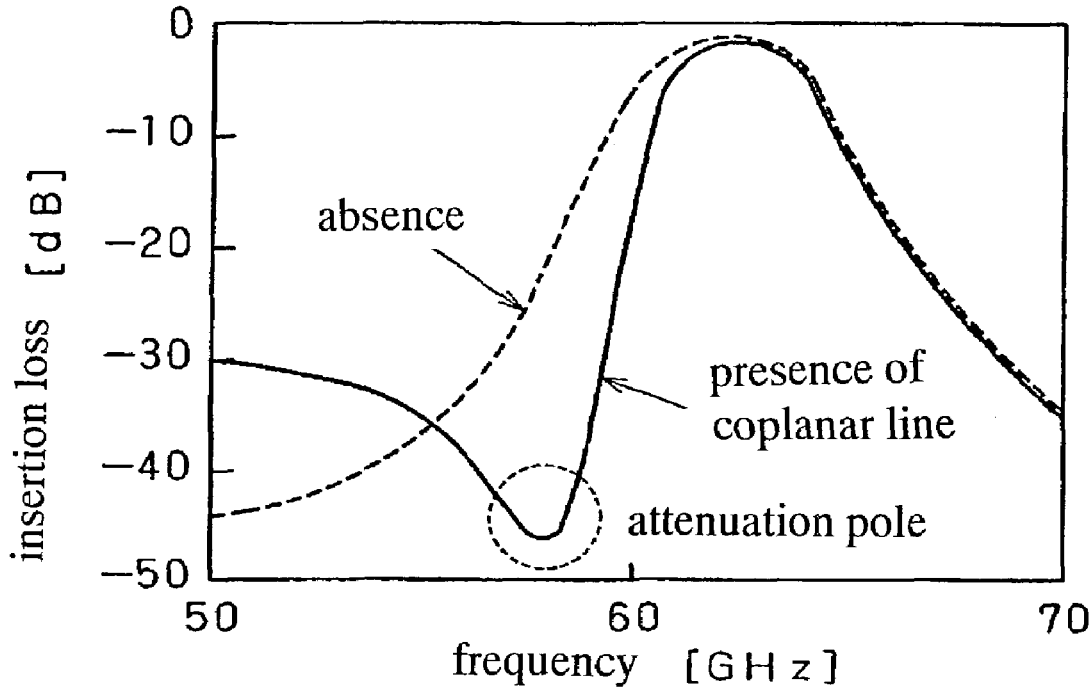
FIG. 12 is a graph showing the effect of improvement in the out-of-band suppressing characteristic obtained by the coplanar line.
Figure 13:
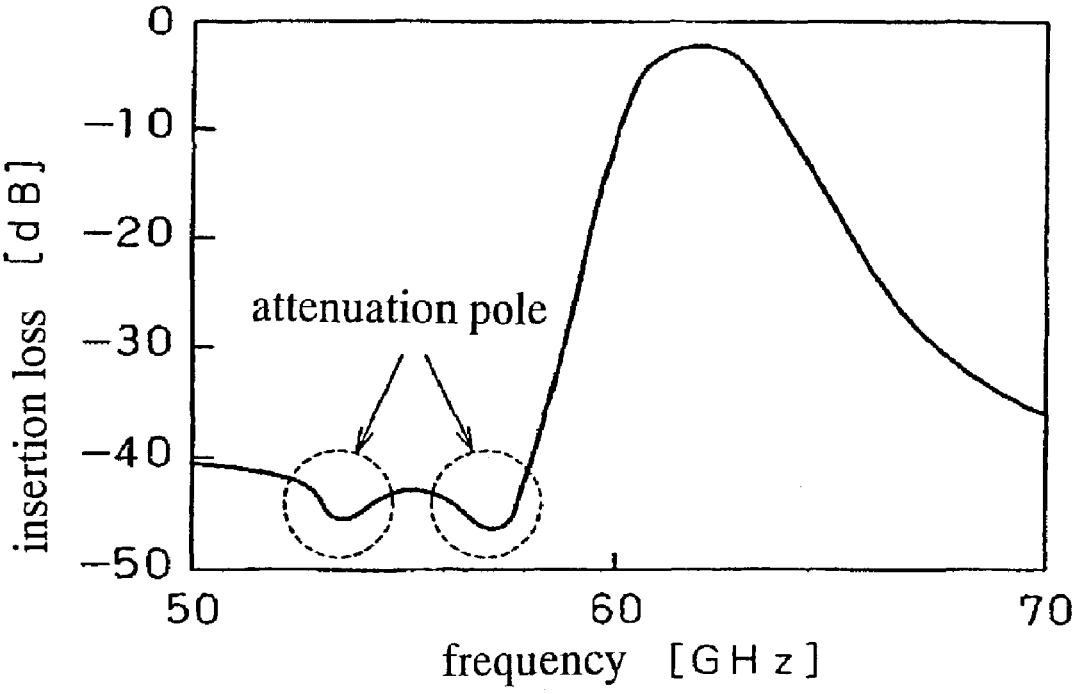
FIG. 13 is a graph showing filter characteristic having two attenuation poles in the low frequency range.
Figure 14:
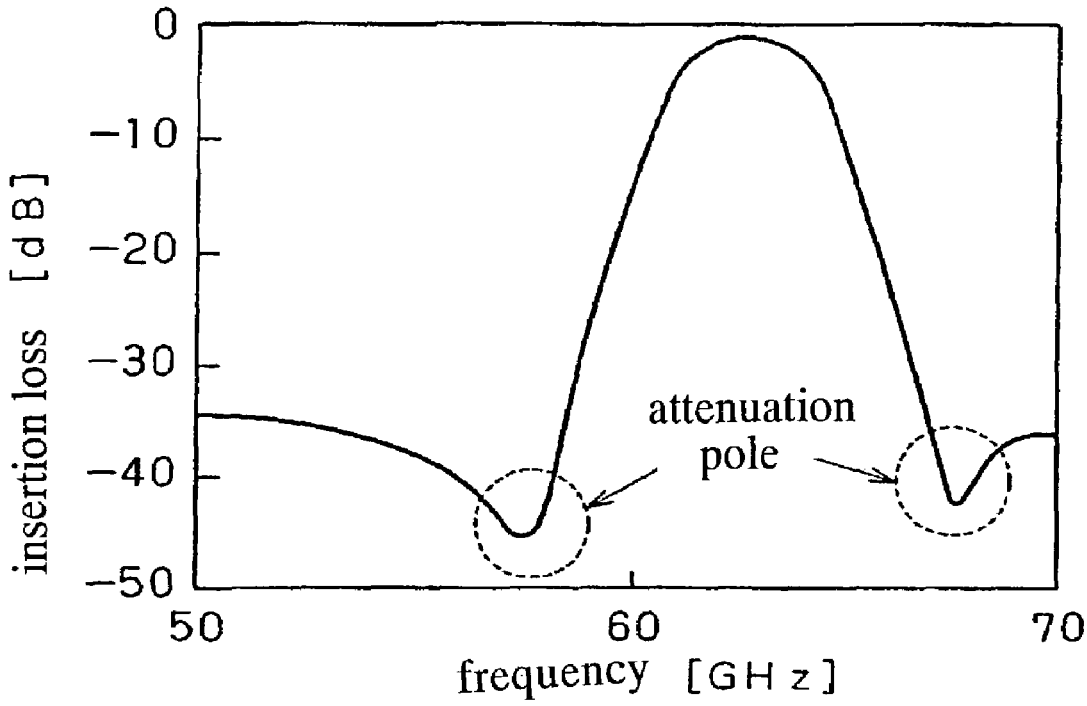
FIG. 14 is a graph showing filter characteristic having an attenuation pole in each of the low frequency range and the high frequency range.

Further, coplanar line 4 (FIG. 1A) having the conductor layer 2*a* as a ground and the conductor layer 2*b* as a signal conductor is formed so as to overstride the inductive windows configured by the via-holes 3*b*. This structure provides a subordinate transmission path having short-circuited ends and having a length, lcpw1, (FIG. 1A) which is around ½ of the in-tube wavelength. FIG. 12 shows the filter characteristic in the cases of presence and absence of the subordinate transmission path. As seen from FIG. 12, addition of the subordinate transmission path introduces an attenuation pole outside the pass band, whereby the out-of-band suppressing characteristic can be significantly improved. As a result, the number of stages of the filter for achieving a desired suppressing characteristic can be reduced compared to the case of absence of the subordinate transmission path, thereby reducing the dimensions of the filter. The attenuation pole may be introduced by a transmission path having open ends and a length, lcpw1, around ½ of the in-tube wavelength such as provided in a second embodiment of the present invention, as shown in FIG. 2, or a transmission path having an open end and a short-circuited end and a length, lcpw1, around ¼ of the in-tube wavelength such as provided in a third embodiment of the present invention, as shown in FIG. 3. In an alternative, a plurality of the transmission paths may be provided, as in the fourth embodiment shown in FIG. 4. FIG. 13 shows the filter characteristic in the case where the coplanar line 4 has different line lengths lcpw1 and lcpw2 as shown in FIG. 4. As understood from FIG. 13, by changing the line lengths lcpw1 and lcpw2 independently of one another, the attenuation poles can be controlled independently of each other, whereby the out-of-band component can be suppressed over a wide band range. In this example, the attenuation pole is formed in a lower frequency range of the pass band; however, the attenuation pole may be introduced in the higher frequency range or each of the lower and higher frequency ranges as shown in FIG. 14.

Figure 5A:
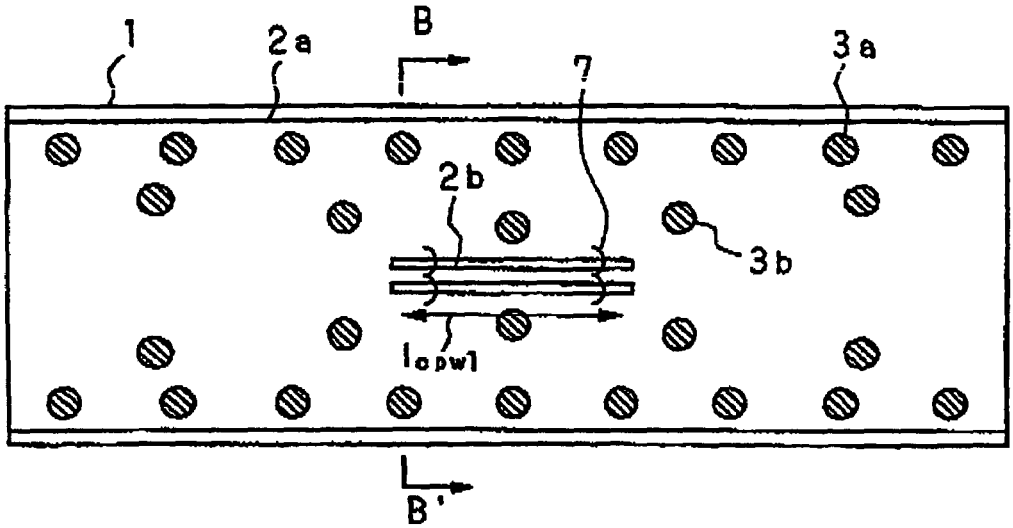
FIG. 5A is a top plan view of a filter according to a fifth embodiment of the present invention.
Figure 5B:
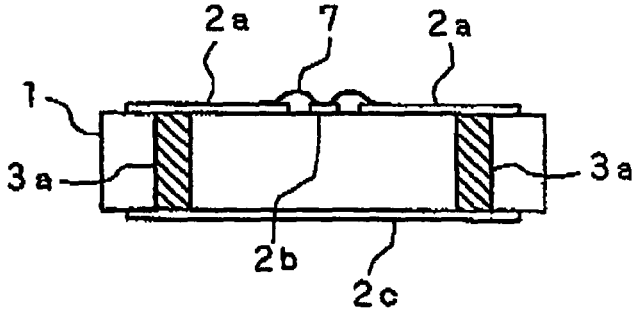
FIG. 5B is a sectional view taken along line B–B' in FIG. 5A.

With reference to FIGS. 5A and 5B, a fifth embodiment will be described having a configuration wherein the filter characteristic can be adjusted. By connecting together the conductor layer 2*a* constituting the ground of the coplanar line 4 (FIG. 5A) and the conductor layer 2*b* constituting the signal conductor thereof via bonding wires 7 (FIG. 5B), the short-circuit point of the short-circuited-ends coplanar line 4 (FIG. 5A) constituting the subordinate transmission path can be shifted. By this structure, the frequency at which the attenuation pole appears is changed to adjust the filter characteristic. Instead of the bonding wire 7 (FIG. 5B), a gold ribbon etc. may be used. Or else, an air bridge etc., which connects the conductor layer 2*a* and the conductor layer 2*b* together is formed in advance during forming the conductor layer on the top surface of the dielectric substrate 1, and is removed for allowing adjustment of the filter characteristic.

Figure 6A:
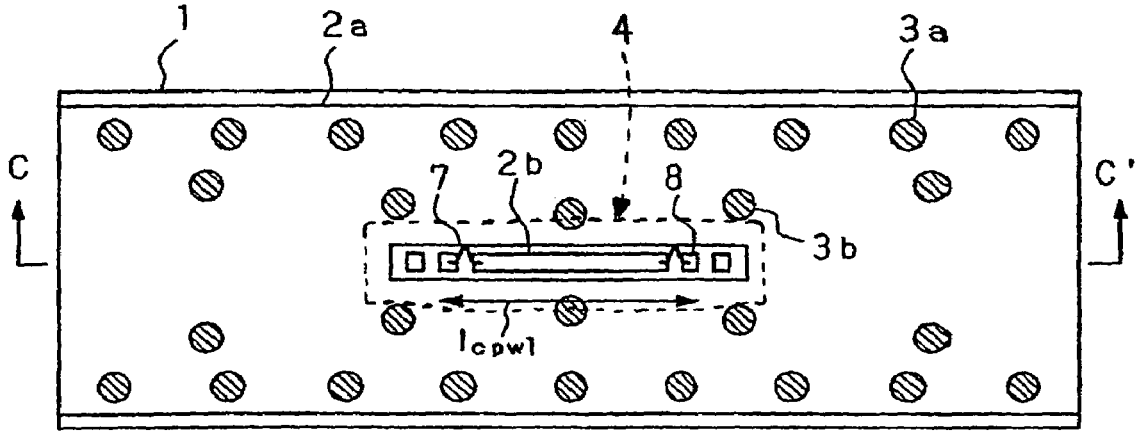
FIG. 6A is a top plan view of a filter according to a sixth embodiment of the present invention.
Figure 6B:
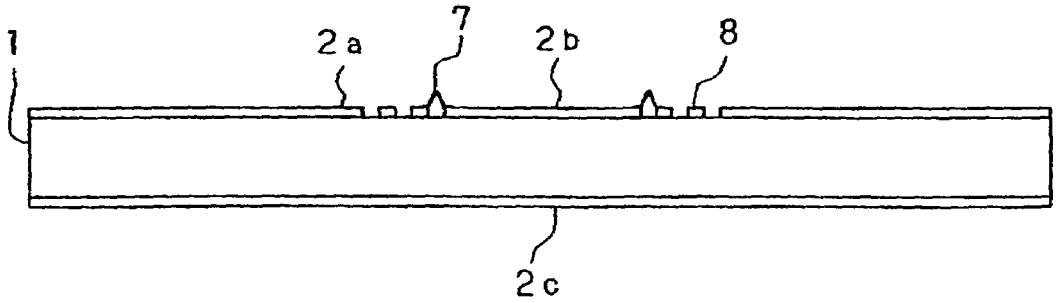
FIG. 6B is a sectional view taken along line C–C' in FIG. 6A.

With reference to FIGS. 6A and 6B, a sixth embodiment will be described having another configuration wherein the filter characteristic can be adjusted. A plurality of conductor pieces 8 are formed in advance at locations apart from the conductor layer 2*b* constituting the signal conductor. By connecting together the conductive pieces 8 and the conductor layer 2*b* by using bonding wires 7, the open point of the coplanar line 4 (FIG. 6A) having open ends and constituting the subordinate transmission path can be shifted, whereby the filter characteristic can be adjusted as in the case of the short-circuited ends.

Figure 7A:
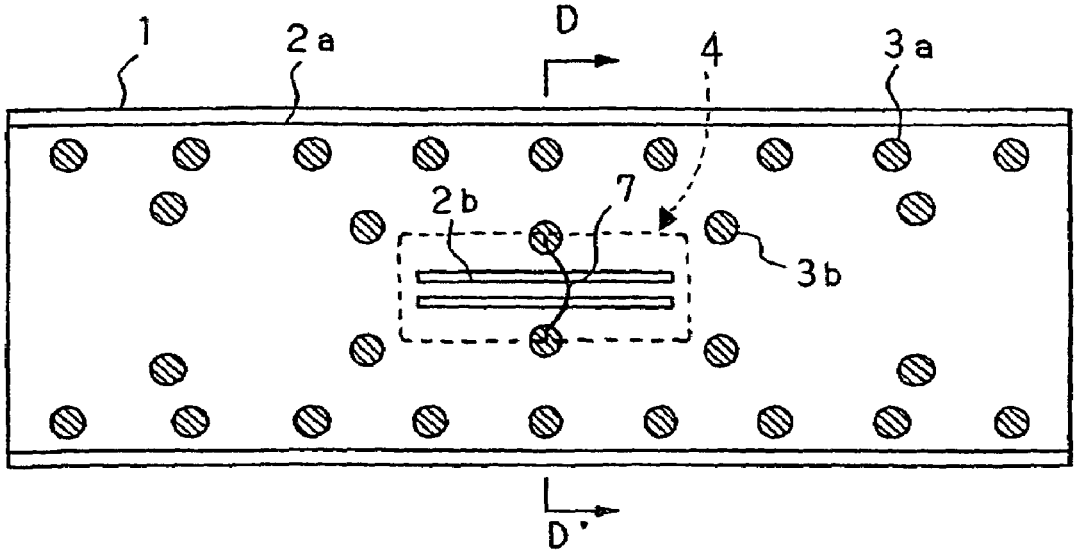
FIG. 7A is a top plan view of a filter according to a seventh embodiment of the present invention.
Figure 7B:
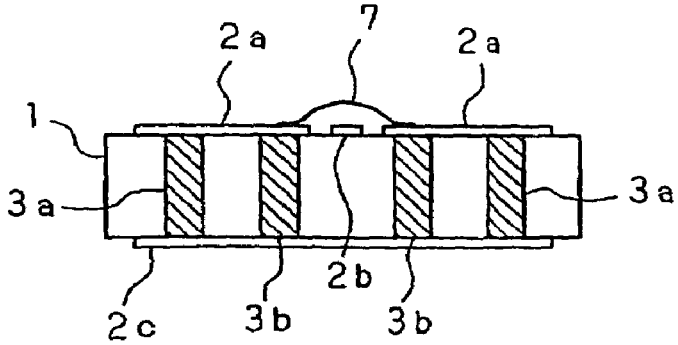
FIG. 7B is a sectional view taken along line D–D' in FIG. 7A.

In the above embodiments, the filter characteristic may be sometimes degraded due to transmission of the parasitic slot line mode through the coplanar line 4 constituting the subordinate transmission path. With reference to FIGS. 7A and 7B, the configuration for suppressing the parasitic slot line mode as a seventh embodiment will be described. The conductor layers 2*a* disposed at both sides of the conductor layer 2*b* constituting the signal conductor of the coplanar line 4 (FIG. 7A) are connected together via a bonding wire 7. This allows suppression of the slot line mode due to nullifying the potential difference between the conductor layers 2*a* disposed at both sides of the conductor layer 2*b*.

Figure 8A:
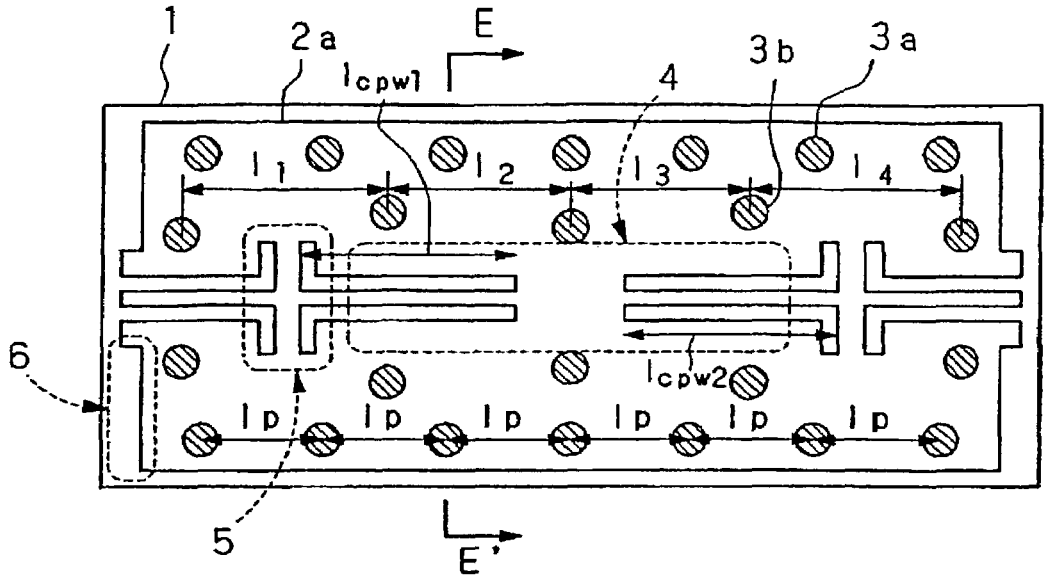
FIG. 8A is a top plan view of a filter according to an eighth embodiment of the present invention.
Figure 8B:
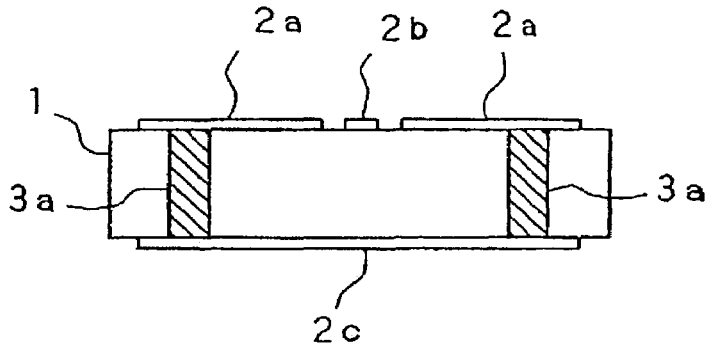
FIG. 8B is a sectional view taken along line E–E' in FIG. 8A.

With reference to FIGS. 8A and 8B, an eighth embodiment of the present invention will be described in detail. Conductor layers 2*a* and 2*c* (FIG. 8B) are formed on the top and bottom surfaces, respectively, of a dielectric substrate 1 such as made of ceramics, wherein the top conductor layer 2*a* and the bottom conductor layer 2*c* are connected together through via-holes 3*a* penetrating the dielectric substrate 1. The plurality of via-holes 3*a* are arranged in at least two rows along the signal transfer direction. In order for the area surrounded by the top conductor layer 2*a*, bottom conductor layer 2*c* and via-holes 3*a* to configure a waveguide tube in a desired band, it is preferable that the spacing lp between the via-holes 3*a* in the direction parallel to the signal transfer direction be equal to or less than ½ of the in-tube wavelength in the desired band as shown in FIG. 8A. In addition, in order to sufficiently suppress the loss due to radiation from between the via-holes 3*a*, it is preferable that the spacing be equal to or less than ¼ of the in-tube wavelength. By forming via-holes 3*b* (FIG. 8A) arranged in the signal transfer direction at spacings (11, 12, 13 and 14) in FIG. 8A equal to or below ½ of the in-tube wavelength, the zone between the via-holes 3*b* (FIG. 8A) constitutes a resonator. By connecting adjacent resonators together via via-holes 3*b* constituting inductive windows, a dielectric band-pass filter can be configured. By configuring the coplanar line as a signal input/output line, and using a coplanar waveguide tube conversion section 5 (FIG. 8A) formed on the dielectric substrate 1, the coupling factor of the filter with respect to the outside thereof can be adjusted. The configuration wherein the coplanar line is used as the input/output line allows integration of the filter with the planar circuit of a MMIC (monolithic microwave integrated circuit) etc., whereby flip-chip mounting generally used in a high frequency range can be employed.

Since the most part of the electromagnetic wave is transmitted within the waveguide tube, it is expected that the characteristics are scarcely changed even in the case of the flip-chip mounting. By applying an offset 6 (FIG. 8A) with respect to a part of the conductor layer 2*a* constituting the input/output section except for the coupling portion to the outside, radiation from the end of the substrate can be reduced. By forming the coplanar line 4 (FIG. 8A) including the conductor layer 2*a* as the ground and the conductor layer 2*b* as the signal conductor on the surface of the dielectric substrate 1 so as to overstride two resonators, a subordinate transmission path having short-circuited ends is formed, with the waveguide tube being the main transmission path. The subordinate transmission path provides effects similar to those of the first embodiment. The configuration of the transmission path may be such as having open ends, or having an open end and a short-circuited end, as recited in connection with the second and third embodiments, or may be changed in the number of transmission paths.

Figure 9:
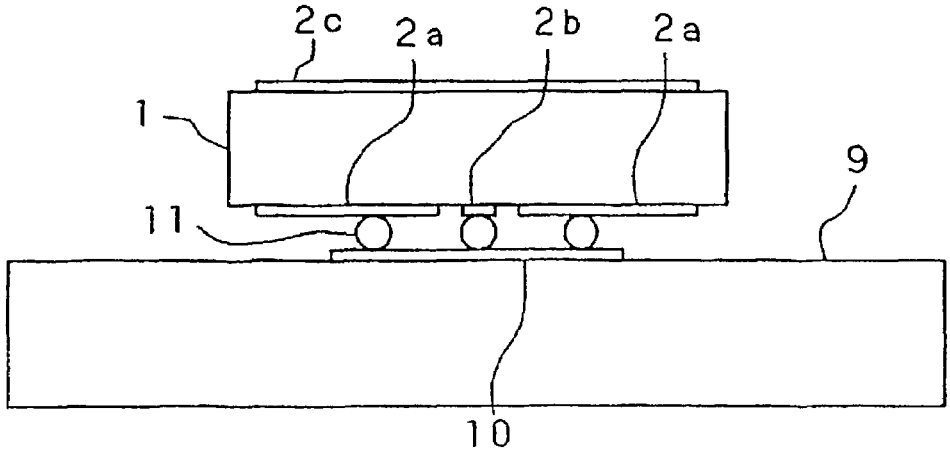
FIG. 9 is a sectional view of a filter according to a ninth embodiment of the present invention.

Also in such a case, the characteristic of the filter can be adjusted similarly to the case of configuration of the fifth embodiment (FIGS. 5A and 5B); however, flip-chip mounting can be used with ease due to the coplanar line being an input/output section. FIG. 9 shows a ninth embodiment, wherein a filter having a configuration for adjusting the filter characteristic by using a flip-chip mounting technique is shown in a sectional view together with the mounting board. Upon flip-chip bonding the filter substrate, the conductor layer 2*a* and the conductor layer 2*b* are connected together via the bumps 11 and a conductor piece 10 which is formed on the flip-chip mounting board 9, whereby the short-circuit point of the transmission path having sort-circuited ends can be adjusted. This allows adjustment of the filter characteristic similarly to the case of the bonding wire 7.

Figure 10:
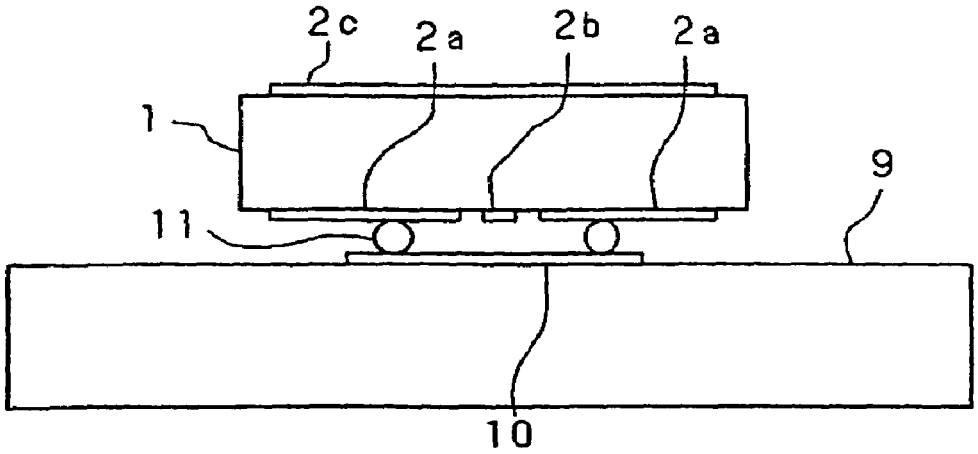
FIG. 10 is a sectional view of a filter according to a tenth embodiment of the present invention.
Figure 11A:
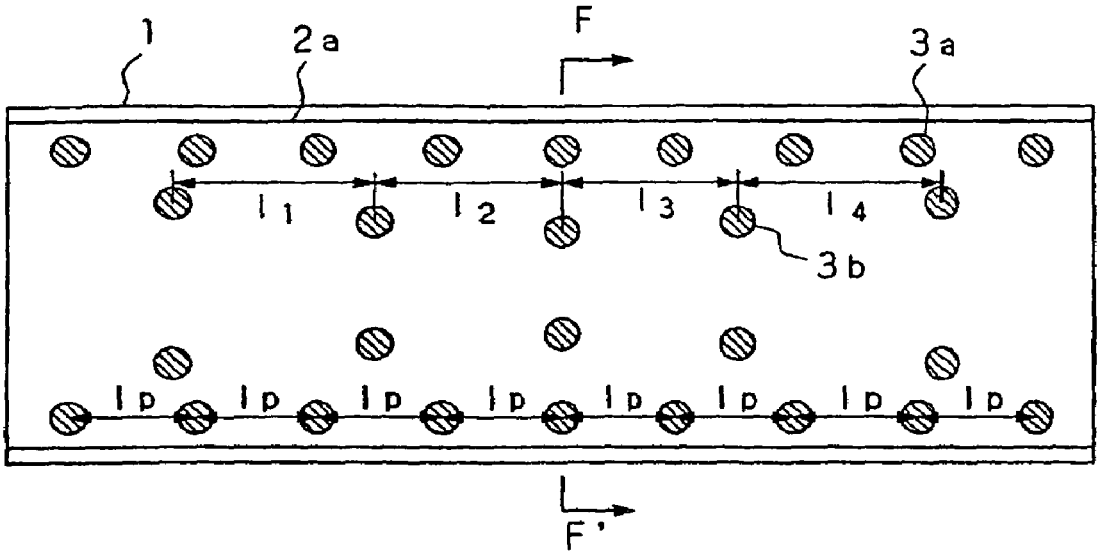
PRIOR ART Fig. 11A
FIG. 11A is a top plan view of a conventional filter.
Figure 11B:
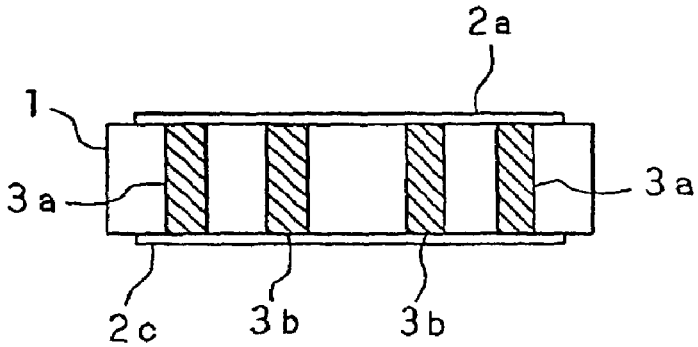
Fig. 11B PRIOR ART
FIG. 11B is a sectional view taken along line F–F' in FIG. 11A.

The slot line mode can be suppressed similarly to the method of the seventh embodiment, and also by using a flip-chip mounting technique. FIG. 10 shows a tenth embodiment, wherein a filter having a configuration for suppressing the slot line mode by using the flip-chip mounting technique is shown in sectional view together with the mounting board. Upon mounting the filter substrate by the flip-chip mounting technique, the conductor layers 2*a* disposed at both sides of the conductor layer 2*b* are connected together via bumps 11 and a conductive piece 10 which is formed on the mounting board 9, whereby effects similar to those of the bonding wire 7 can be obtained.

In the above description, the length of the resonator along the direction parallel to the signal transfer direction is equal to or below ½ of the in-tube wavelength; however, the length may be an integral multiple of ½ of the in-tube wavelength. In addition, the subordinate transmission path is exemplified by a coplanar line; however, a slot line may be used therein, for example. The filter having four stages is exemplified; however, the number of stages may be increased or decreased therefrom to obtain desired characteristics.

In the dielectric waveguide tube band-pass filter, due to the planar line provided on the conductor plane disposed on the dielectric substrate, a subordinate transmission path is formed, with the waveguide tube being the main transmission path, and an attenuation pole is formed outside the band of the filter, whereby the out-of-band suppression characteristic can be improved. This allows reduction of the number of stages in the filter, thereby achieving smaller dimensions.

The planar line can be formed on the dielectric waveguide tube with more ease compared to the case of forming the same on the metallic waveguide tube. Accordingly, the out-of-band suppression characteristic of the filter can be improved by the simple configuration. The reduction of the number of stages in the filter allows improvement of the product yield.

In a filter having a pseudo waveguide tube structure configured by the top conductor layer and the bottom conductor layer formed on the surfaces of the dielectric substrate, the structure wherein a planar line is provided on the conductor surface on the dielectric substrate, if employed, can form an attenuation pole outside the band of the filter to improve the out-of-band suppression characteristic of the filter.

A configuration wherein the planar line provided on the dielectric substrate configures a secondary transmission path connecting the resonators together, if employed, can form an attenuation pole outside the pass band of the filter to improve the out-of-band suppression characteristic.

A configuration wherein coplanar line including two combined slots is used as the coplanar line formed on the dielectric substrate, if employed, concentrates the electric field on the slot to thereby improve the filter characteristic.

A configuration wherein the ground conductors disposed on both sides of the signal conductor constituting the co-planar line are connected together, if employed, suppresses the slot line mode which may be generated as a higher-order mode of the coplanar line, whereby degradation of the filter characteristic due to the slot line mode can be prevented.

A configuration wherein the conductors provided on both sides of the slot constituting the coplanar line are connected together via a conductor piece for adjusting the filter, if employed, can adjust the position of the short-circuit end of the line having the short-circuited ends to thereby adjust the filter characteristic.

A configuration wherein at least one end of the co-planar line is an open end, a first conductor piece is formed apart from the open end of a signal conductor, and the first conductor piece and said signal conductor are connected together via a second conductor piece for adjusting the filter, if employed, can adjust the position of the open end having the open end, thereby allowing adjustment of the filter characteristic.

A conversion structure wherein the coplanar line is converted to a waveguide tube, if employed, provides a filter capable of being flip-chip mounted.

A configuration wherein conductors constituting the coplanar line are connected together via bumps and a conductor piece which is formed on the flip-chip mounting board, if employed, provides a filter which allows both suppression of the slot line mode and adjustment of the characteristic thereof.

The invention claimed is:

1. A filter comprising a dielectric waveguide tube structure including a top conductor layer and a bottom conductor layer on surfaces of a dielectric substrate, wherein a side wall of the dielectric waveguide tube and inductive windows are configured by conductors connecting said top conductor layer and said bottom conductor layer together;

a planar line is configured on the surface of at least one of said top conductor layer and said bottom conductor layer; and wherein said planar line comprises a slot and conductors on both sides of said slot are connected together via a conductor piece for adjusting said filter.

2. The filter according to claim 1, where said planar line is a coplanar line for inputting or outputting a signal and said filter further comprises a conversion structure for the waveguide tube.

3. The filter according to claim 1, wherein said planar line further comprises a second slot disposed along a signal transfer direction in the waveguide tube so as to configure a co-planar line;

wherein a signal conductor is formed between said slots and said conductor piece connects ground conductors disposed on both sides of said signal conductor.

4. The filter according to claim 3, wherein the coplanar line inputs or outputs a signal, and said filter further comprises a conversion structure for the waveguide tube.

5. The filter according to claim 3, wherein said conductor piece is disposed on a flip-chip mounting board and bumps.

6. The filter according to claim 1 wherein:

said conductors connecting said top conductor layer and said bottom conductor layer comprise via holes;

said via holes are disposed in at least a first via hole array and a second via-hole array;

said via-holes in said first via hole array and said second via hole array are arranged in a signal transfer direction at spacing equal to or below ½ of an in-tube wavelength in a desired band; and wherein said inductive windows are configured by said second via hole arrays and couple together resonators in said waveguide tube; said resonators being configured by an area surrounded by said first and second via-hole arrays, said top conductor layer and said bottom conductor layer.

7. A filter comprising a dielectric waveguide tube structure including a top conductor layer and a bottom conductor layer on surfaces of a dielectric substrate, wherein a side wall of the dielectric waveguide tube and inductive windows are configured by conductors connecting said top conductor layer and said bottom conductor layer together;

a planar line is configured on the surface of at least one of said top conductor layer and said bottom conductor layer;

said planar line disposed on said dielectric substrate is a co-planar line configured by two slots disposed along a signal transfer direction in the waveguide tube;

at least one of the opposite ends of said co-planar line is an open end, and a first conductor piece is disposed apart from said open end of a signal conductor; and said first conductor piece and said signal conductor are connected together via a second conductor piece for adjusting said filter.

8. The filter according to claim 7, wherein said filter includes a coplanar line for inputting/outputting a signal, and a conversion structure for the waveguide tube.

9. The filter according to claim 7, wherein ground conductors disposed on both sides of said planar line are connected together via a third conductor piece disposed on a flip-chip mounting board and bumps.

10. The filter according to claim 7, wherein ground conductors on both sides of said signal conductor configuring said coplanar line are connected together via a third conductor piece.

11. A filter comprising:

a dielectric waveguide tube structure including a top conductor layer and a bottom conductor layer on surfaces of a dielectric substrate; and a conversion section formed on one of the surfaces of the dielectric substrate;

wherein a side wall of the dielectric waveguide tube and inductive windows are configured by conductors connecting said top conductor layer and said bottom conductor layer together;

wherein a coplanar line is configured on the surface of at least one of said top conductor layer and said bottom conductor layer, the coplanar line is disposed so as to overstride at least one of said inductive windows, and the coplanar line configures a subordinate transmission path; and wherein the coplanar line is a signal input/output line directly connected to the conversion section so that the coplanar line is coupled with the waveguide tube and adjusts the coupling factor of the filter.

12. The filter according to claim 11, wherein ground conductors on both sides of a signal conductor configuring said coplanar line are connected together via a conductor piece.

13. The filter according to claim 12, wherein the conductor piece is disposed on a flip-chip mounting board and bumps.

14. A filter comprising:

a dielectric waveguide tube structure including a top conductor layer and a bottom conductor layer on surfaces of a dielectric substrate; and a conversion section formed on one of the surfaces of the dielectric substrate, wherein a side wall of the dielectric waveguide tube and inductive windows are configured by conductors connecting said top conductor layer and said bottom conductor layer together;

wherein a first coplanar line is configured on the surface of at least one of said top conductor layer and said bottom conductor layer, the first coplanar line is disposed so as to overstride at least one of said inductive windows, and the first coplanar line configures a subordinate transmission path;

wherein a second coplanar line is configured on the surface of one of said top conductor layer and said bottom conductor layer for inputting or outputting a signal; and wherein the first coplanar line is directly connected to the conversion section so that the first coplanar line is coupled with the second coplanar line.

* * * * *